US007909161B2

(12) United States Patent
Sween et al.

(10) Patent No.: US 7,909,161 B2
(45) Date of Patent: Mar. 22, 2011

(54) CASE CONFIGURED TO HOLD PORTABLE COMPUTER AND METHOD OF MANUFACTURING AND USING THE SAME

(75) Inventors: Barry Sween, Santa Monica, CA (US); Kenneth Mori, Los Angeles, CA (US); Mike Simonian, San Francisco, CA (US); Maaike Evers, San Francisco, CA (US); Sarahut Sirichai, Hong Kong (CN)

(73) Assignee: Belkin International, Inc., Playa Vista, CA (US)

( * ) Notice: Subject to any disclaimer, the term of this patent is extended or adjusted under 35 U.S.C. 154(b) by 599 days.

(21) Appl. No.: 11/888,095

(22) Filed: Jul. 31, 2007

(65) Prior Publication Data

US 2009/0032421 A1 Feb. 5, 2009

(51) Int. Cl.
*B65D 85/00* (2006.01)

(52) U.S. Cl. ..... 206/320; 206/576; 190/109; 190/115

(58) Field of Classification Search ..... 206/320, 206/305, 576, 579, 702, 701, 723; 190/102, 190/109, 111, 115; 220/501, 502, 525
See application file for complete search history.

(56) References Cited

U.S. PATENT DOCUMENTS

| | | | | |
|---|---|---|---|---|
| 1,190,492 | A | 7/1916 | Way, Jr. | |
| D55,451 | S | 6/1920 | Carraine | |
| 1,571,475 | A | 2/1926 | Guenther | |
| 1,771,168 | A | 7/1930 | Droutman | |
| 1,826,976 | A | 10/1931 | Wright | |
| 2,211,660 | A * | 8/1940 | Kidd et al. | 312/231 |
| 2,516,266 | A | 7/1950 | Simpson | |
| D204,818 | S | 5/1966 | Sussman | |
| 3,255,951 | A | 6/1966 | Kay | |
| 3,302,860 | A | 2/1967 | Schwarzkopf | |
| 3,371,975 | A * | 3/1968 | Meltzer | 55/385.1 |
| 3,462,069 | A | 8/1969 | Suominen | |
| 3,468,470 | A | 9/1969 | Sengewald | |
| 3,506,185 | A | 4/1970 | Christensen | |
| D219,416 | S | 12/1970 | Wonsavage | |
| 3,675,843 | A | 7/1972 | Polansky | |
| 3,741,355 | A | 6/1973 | Slan | |
| D254,221 | S | 2/1980 | Beekenkamp | |

(Continued)

OTHER PUBLICATIONS

Laptop Case; http://championcase.en.alibaba.com/product/10273762/10366580/Laptop_Case_and_Bag/Laptop_Case.html; Sep. 11, 2006; 4 pages.

(Continued)

*Primary Examiner* — David T Fidei
(74) *Attorney, Agent, or Firm* — Bryan Cave LLP

(57) ABSTRACT

A case (100) can be configured to hold a portable computer (350) with a keyboard (351). In one embodiment, the case can include: (a) a base shell (120) having: (1) a base panel (121) with a first side (144); and (2) one or more pads (231) extending from the first side and positioned such that a bottom of the portable computer is capable of resting on the one or more pads; and (b) a cover shell (110) coupled to the base shell and configured to move between a first position relative to the base shell, in which a user cannot type on the keyboard of the portable computer while the portable computer is inside of the case, and a second position relative to the base shell, in which the user can type on the keyboard of the portable computer while the portable computer is inside of the case.

35 Claims, 15 Drawing Sheets

U.S. PATENT DOCUMENTS

| | | | | | |
|---|---|---|---|---|---|
| D260,327 | S | | 8/1981 | Rabinowitz et al. | |
| 4,454,889 | A | | 6/1984 | Contreras, Sr. | |
| D301,642 | S | | 6/1989 | Bakic | |
| 4,863,034 | A | | 9/1989 | Contreras, Sr. | |
| 5,010,988 | A | | 4/1991 | Brown | |
| D316,763 | S | | 5/1991 | Ferrari | |
| D326,226 | S | | 5/1992 | Gerhart | |
| D328,101 | S | | 7/1992 | Rorke | |
| 5,177,665 | A | * | 1/1993 | Frank et al. | 361/679.43 |
| 5,214,574 | A | * | 5/1993 | Chang | 361/679.09 |
| 5,494,157 | A | | 2/1996 | Golenz et al. | |
| 5,524,754 | A | * | 6/1996 | Hollingsworth | 206/320 |
| D374,348 | S | | 10/1996 | Sarver | |
| 5,590,022 | A | * | 12/1996 | Harvey | 361/679.41 |
| 5,676,223 | A | | 10/1997 | Cunningham | |
| 5,775,497 | A | * | 7/1998 | Krulik | 206/320 |
| 5,808,865 | A | * | 9/1998 | Alves | 361/679.31 |
| 5,835,344 | A | | 11/1998 | Alexander | |
| D409,385 | S | | 5/1999 | Pearson et al. | |
| 5,957,583 | A | | 9/1999 | DeClements et al. | |
| D414,977 | S | | 10/1999 | Hales et al. | |
| 6,026,961 | A | * | 2/2000 | McCarthy et al. | 206/576 |
| 6,145,661 | A | * | 11/2000 | Jung | 206/320 |
| D434,796 | S | | 12/2000 | Coleman | |
| D435,591 | S | | 12/2000 | Wyant | |
| D435,964 | S | | 1/2001 | Lentz | |
| 6,237,766 | B1 | * | 5/2001 | Hollingsworth | 206/320 |
| 6,257,407 | B1 | * | 7/2001 | Truwit et al. | 206/320 |
| 6,283,299 | B1 | * | 9/2001 | Lee | 206/760 |
| 6,354,477 | B1 | | 3/2002 | Trummer | |
| D455,930 | S | | 4/2002 | Eskandry | |
| 6,371,288 | B1 | * | 4/2002 | Licata | 206/214 |
| 6,375,009 | B1 | * | 4/2002 | Lee | 206/522 |
| D458,127 | S | | 6/2002 | de Groote | |
| D462,809 | S | | 9/2002 | LaSpina et al. | |
| D467,079 | S | | 12/2002 | Willows et al. | |
| D468,199 | S | | 1/2003 | Lambelet et al. | |
| D473,680 | S | | 4/2003 | Saunders et al. | |
| 6,604,618 | B1 | * | 8/2003 | Godshaw et al. | 190/107 |
| D485,983 | S | | 2/2004 | Gilad | |
| D497,074 | S | | 10/2004 | Dardashti | |
| D500,204 | S | | 12/2004 | Hillman | |
| D503,431 | S | | 3/2005 | Metcalf et al. | |
| 6,888,460 | B2 | | 5/2005 | Ambrefe | |
| 6,935,498 | B1 | | 8/2005 | Ho | |
| 6,977,809 | B2 | | 12/2005 | Bovino | |
| D517,797 | S | | 3/2006 | Lown et al. | |
| D521,728 | S | | 5/2006 | Legay | |
| D529,282 | S | | 10/2006 | Legay | |
| D537,632 | S | | 3/2007 | Quansah | |
| D540,034 | S | | 4/2007 | Gerard et al. | |
| D543,700 | S | | 6/2007 | Parker et al. | |
| D555,352 | S | | 11/2007 | Lown et al. | |
| D565,298 | S | | 4/2008 | Braun | |
| D565,842 | S | | 4/2008 | Falcone | |
| D569,096 | S | | 5/2008 | Swartz et al. | |
| D570,108 | S | | 6/2008 | Lown et al. | |
| D570,109 | S | | 6/2008 | Lown et al. | |
| D577,912 | S | | 10/2008 | Sween et al. | |
| D581,669 | S | | 12/2008 | Sween et al. | |
| 7,628,271 | B1 | * | 12/2009 | Marton | 206/320 |
| 7,652,452 | B2 | * | 1/2010 | Mori et al. | 320/107 |
| 2002/0088726 | A1 | * | 7/2002 | Chou | 206/320 |
| 2003/0178332 | A1 | | 9/2003 | Lindamood | |
| 2004/0134813 | A1 | * | 7/2004 | Domotor | 206/320 |
| 2004/0217027 | A1 | | 11/2004 | Harris et al. | |
| 2006/0226045 | A1 | * | 10/2006 | Murphy, Jr. | 206/576 |
| 2006/0228052 | A1 | | 10/2006 | Hess | |
| 2007/0215501 | A1 | * | 9/2007 | Hanson et al. | 206/320 |
| 2007/0246386 | A1 | * | 10/2007 | Nykoluk et al. | 206/320 |
| 2009/0032421 | A1 | | 2/2009 | Sween et al. | |
| 2009/0173648 | A1 | * | 7/2009 | Geneva | 206/320 |

OTHER PUBLICATIONS

Lapdog Carrying Case/Lap Desk; http://www.a2zsolutions.com/store/SD-LD-001.html; Jul. 30, 2006; 5 pages.

Lap Pro Executive laptop cases: notebook cases with form and function; http://www.lap-pro.com/products/carrying_cases-pg2cN.html; Sep. 11, 2006; 3 pages.

Laptop Case; http://championcase.en.alibaba.com/product/10273762/10366580/Laptop_Case_and_Bag/Laptop_Case/showing.html; Sep. 11, 2006; 3 pages.

Silver Aluminum Laptop Case;—TS-06; http://www.yazmo.com/index.asp?PageAction=VIEWPROD&ProdID=502; Sep. 11, 2006; 4 pages.

Document Bags; http://evertopbag.en.alibaba.com/product/50076010/50348006/Document_Bags/Document_Bags/showimg.html; Sep. 11, 2006; 3 pages.

Computer Lap Desk With Padded Wrist Rest—(Sky Blue); http://www.amazon.com/exec/obidos/ASIN/B0000TQJYM/ref=nosim/robinsdesign; Sep. 8, 2006; 6 pages.

Art Studio Supplies; http://www.robinsdesign.com/art_supplies_work_aids.html; Sep. 8, 2006; pp. 6-7.

Lap Desk Products Page; http://www.lapdesk.com/Default.aspx?tabid=149; Jul. 17, 2006; 6 pages.

Belkin Laptop Hideaway, downloaded Jun. 11, 2008 at http://catalog.belkin.com/IWcatProductPage.process?Product_Id=399455.

Belkin Window Sleeve, downloaded at http://catalog.belkin.com/IWCatProductPage.process?Product_Id=399332 on May 26, 2008.

International Search Report for Application No. PCT/US2009/049338, dated Oct. 6, 2009; 9 pages.

* cited by examiner

CASE CONFIGURED TO HOLD PORTABLE COMPUTER AND METHOD OF MANUFACTURING AND USING THE SAME

FIELD OF THE INVENTION

This invention relates generally to packaging, and relates more particularly to cases for portable computers and methods of manufacturing and using the same.

DESCRIPTION OF THE BACKGROUND

Portable computers have become ubiquitous in today's society. Working almost anywhere and at any time on a portable computer has become a part of the daily lives of millions of people.

To transport portable computers from place to place, most people use computer cases. Computer cases provide protection from mechanical shock due to accidental impacts and also provide some degree of protection from environmental hazards, such as heat, light, and dust, for example. To provide adequate protection from this multitude of hazards, however, most computer cases are large and bulky, and are designed such that the computer must be removed from the computer case prior to use.

Moreover, with the decreasing cost of portable computers and increasing availability of wireless networks and applications, many families have replaced desktop computers with portable computers as their primary home computers.

While traditional large and bulky computer cases offer the protection necessary for moving computers over long distances (e.g. for work to home), these computer cases are cumbersome to use within the home. Before moving the computer, traditional computer cases require a time consuming process of shutting down the computer and disconnecting wires, power supplies, and peripherals. A user then packs the computer, power supplies, wires, and peripherals in the case. Because of this lengthy process, home portable computer users usually eschew using computer cases when moving the computer around the home (e.g. from room to room) and, thus, risk damage from accidental impacts or environmental hazards.

Therefore, a need exists for a lightweight computer case that provides protection from environmental hazards and accidental impacts, but also allows the user quick and easy access to the computer.

Figure 1:
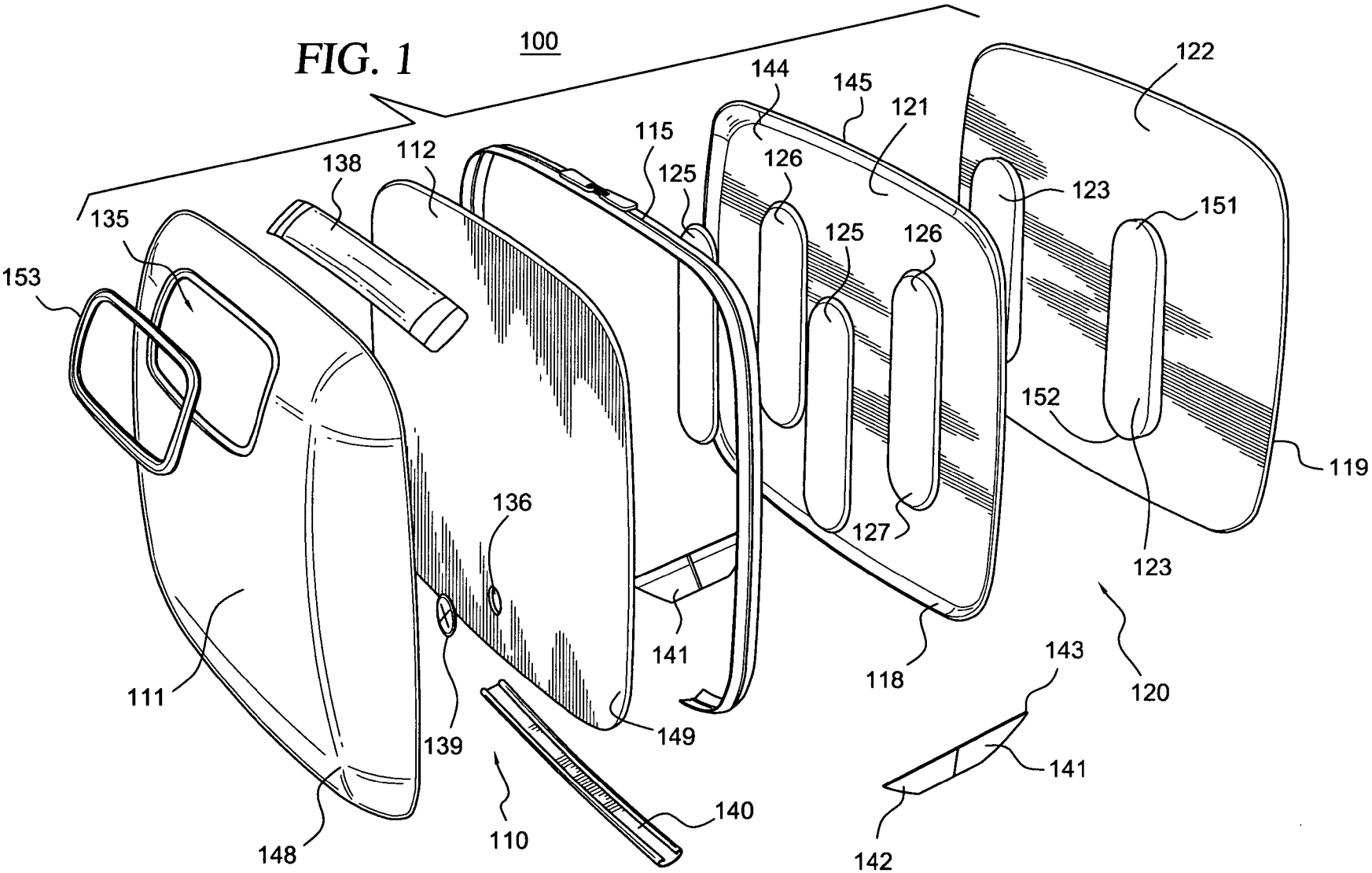
FIG. 1 illustrates an exploded view of a computer case, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "on," as used herein, is defined as on, at, or otherwise adjacent to or next to or over.

The terms "couple," "coupled," "couples," "coupling," and the like should be broadly understood and refer to connecting two or more elements or signals, electrically and/or mechanically, either directly or indirectly through intervening circuitry and/or elements. Coupling (whether only mechanical, only electrical, or both) may be for any length of time, e.g., permanent or semi-permanent or only for an instant.

The absence of the word "removably," "removable," and the like near the word "coupled," and the like does not mean that the coupling, etc. in question is or is not removable.

DETAILED DESCRIPTION OF EXAMPLES OF EMBODIMENTS

In a number of embodiments, a case can be configured to hold a portable computer with a keyboard. The case can include: (a) a base shell having: (1) a base panel with a first side; and (2) one or more pads extending from the first side and positioned such that a bottom of the portable computer is capable of resting on the one or more pads; and (b) a cover shell coupled to the base shell and configured to move between a first position relative to the base shell, in which a user cannot type on the keyboard of the portable computer while the portable computer is inside of the case, and a second position relative to the base shell, in which the user can type on the keyboard of the portable computer while the portable computer is inside of the case.

In other embodiments, a clamshell structure can be configured to contain a portable computer with a keyboard. The clamshell structure can include: (a) a bottom casing; (b) a top casing having: (1) an outer top casing with one or more apertures; and (2) an inner top casing with one or more apertures; and (c) a hinge pivotally coupling together the top casing and the bottom casing. In these embodiments, the inner top casing can be coupled to the outer top casing such that a pocket is formed between the outer top casing and the inner top casing. The one or more apertures in the outer top casing and the one or more apertures in the inner top casing can open into the pocket. Moreover, a user can use the keyboard of the portable computer while the portable computer is inside of the clamshell structure.

In yet other embodiments, a case can include: (a) a first compartment; and (b) a second compartment adjacent to the first compartment and having an opening at an exterior of the case. In these embodiments, the opening of the second compartment is a first portion of a handle for the case.

In still further embodiments, a method of manufacturing a case configured to hold a portable computer can include: (a) providing a base shell; (b) providing a cover shell including: (1) providing a first panel with one or more first openings; (2) providing a second panel with one or more second openings; and (3) coupling the first panel to the second panel to form a pocket between the first panel and the second panel; (c) providing a hinge; (d) coupling the hinge to the cover shell; and (e) coupling the hinge to the base shell.

In additional embodiments, a method of operating a computer can include: (a) providing a computer case having: (1) a first shell; (2) a second shell having: (i) a first panel with an interior side; and (ii) one or more pads extending from the interior side; and (3) a hinge coupling the first shell to the second shell; (b) placing the computer on the one or more pads; and (c) operating the computer while the computer is resting on the one or more pads.

Figure 2:
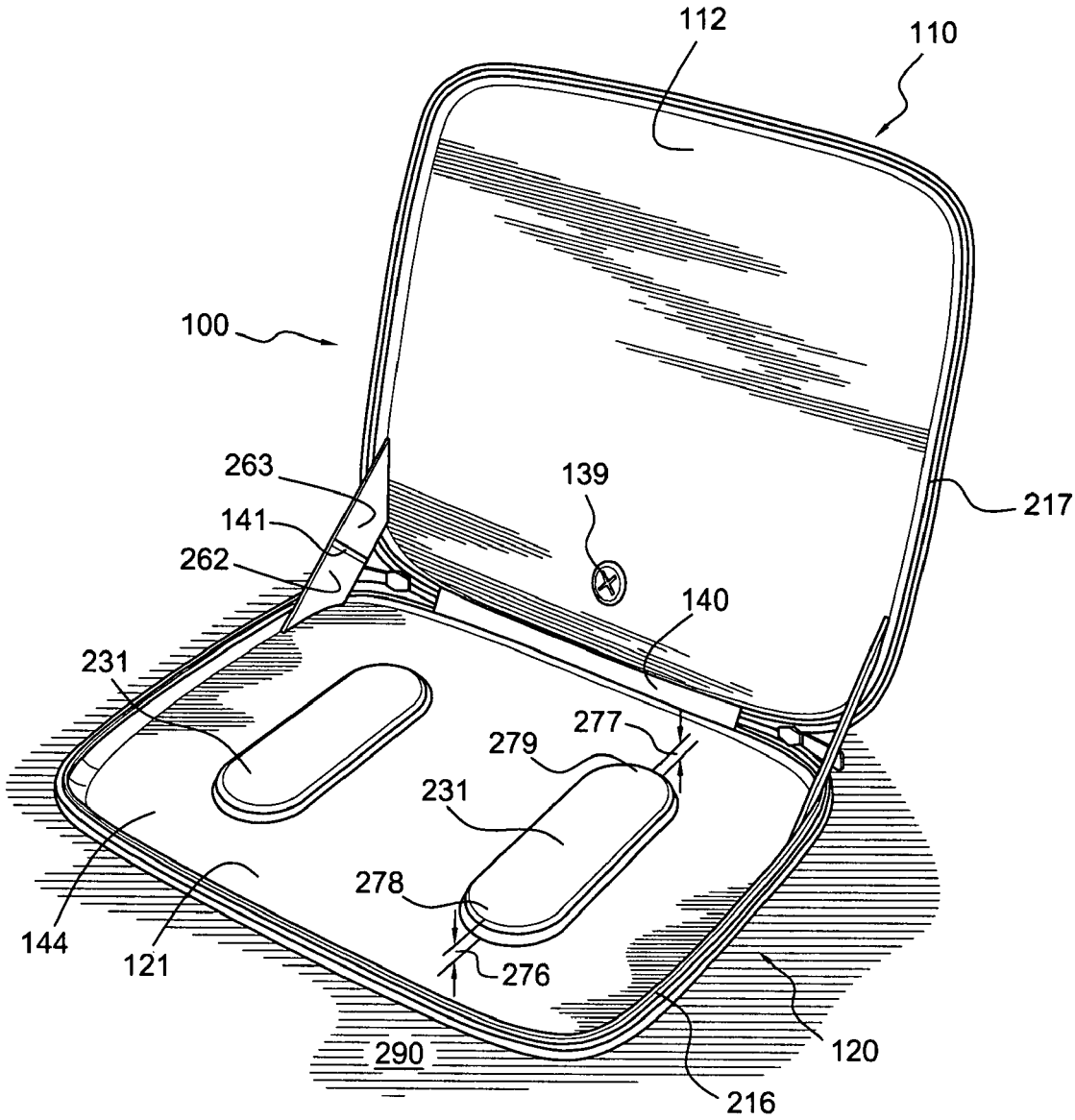
FIG. 2 illustrates a front, right isometric view of the computer case of FIG. 1 in an open position, according to the first embodiment.
Figure 3:
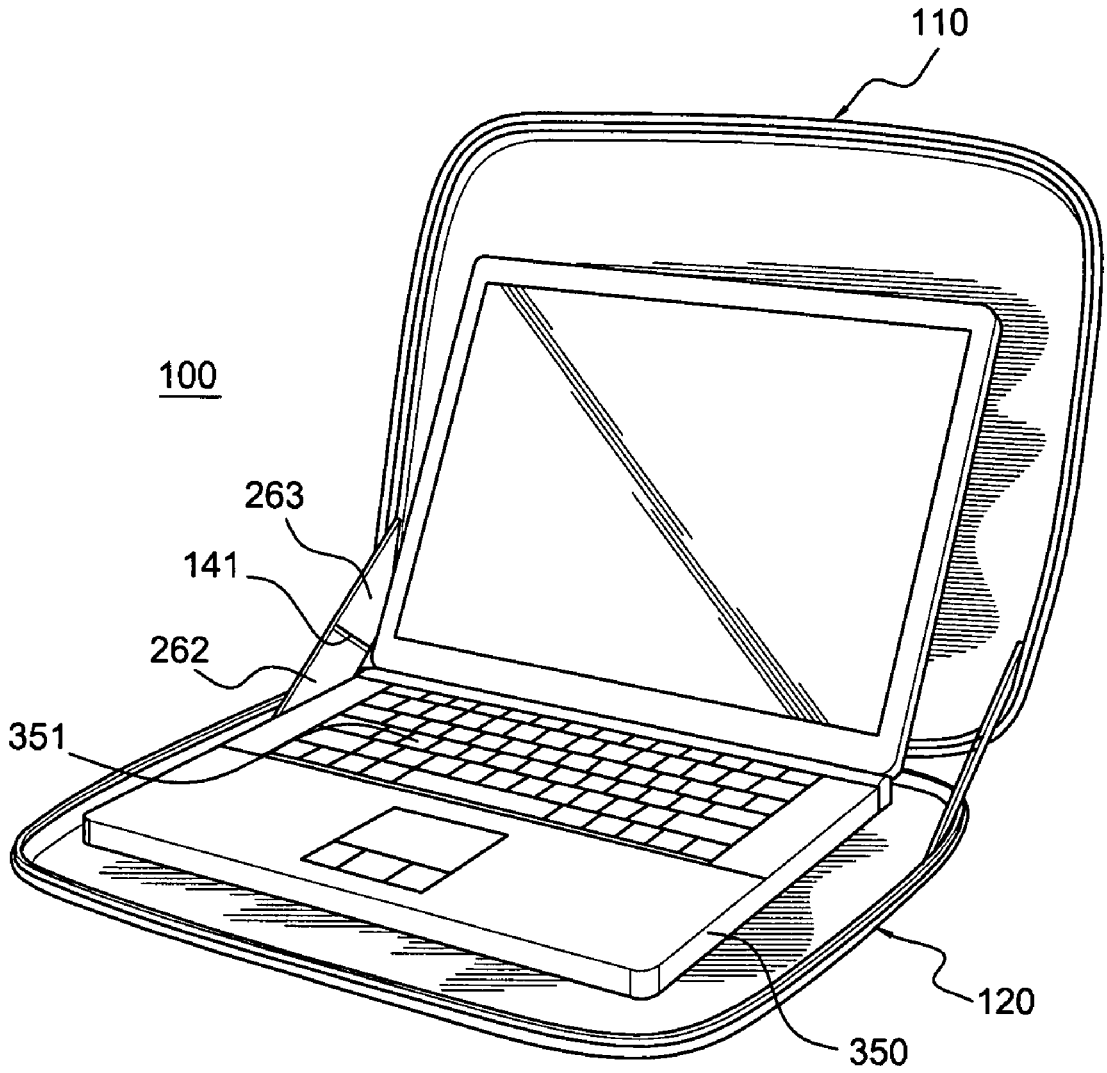
FIG. 3 illustrates a front, right isometric view of the computer case of FIG. 1 in the open position with a portable computer located within the computer case of FIG. 1, according to the first embodiment.
Figure 4:
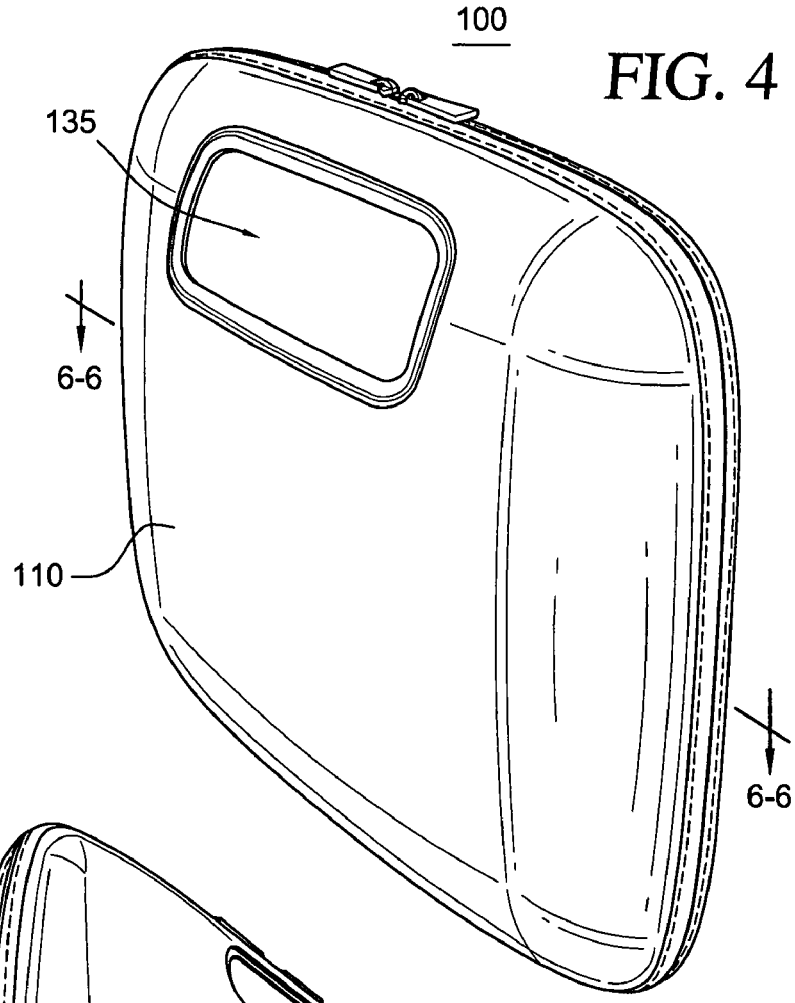
FIG. 4 illustrates a right, top isometric view of the computer case of FIG. 1 in a closed position, according to the first embodiment.
Figure 5:
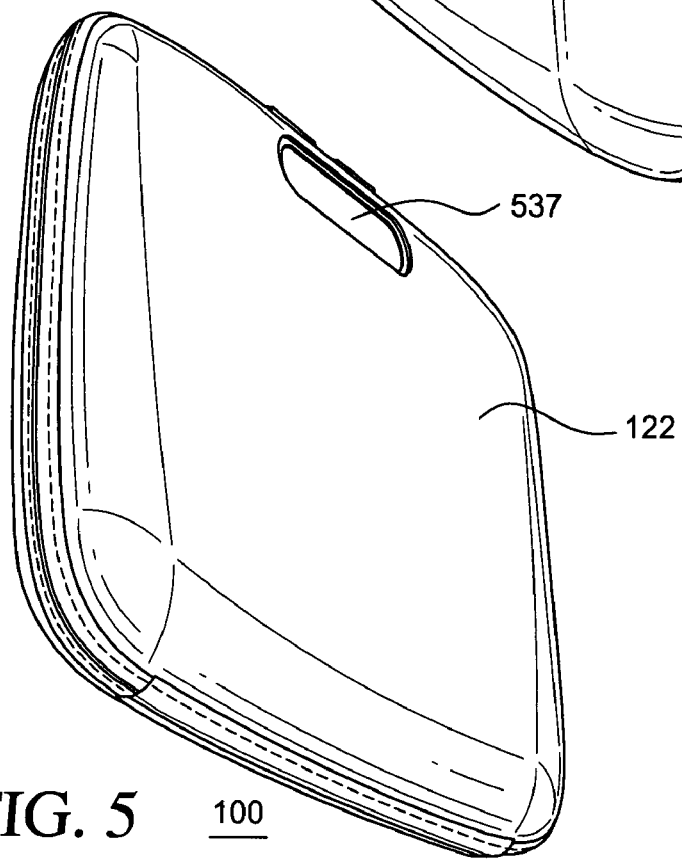
FIG. 5 illustrates a left, bottom isometric view of the computer case of FIG. 1 in the closed position, according to the first embodiment.
Figure 6:
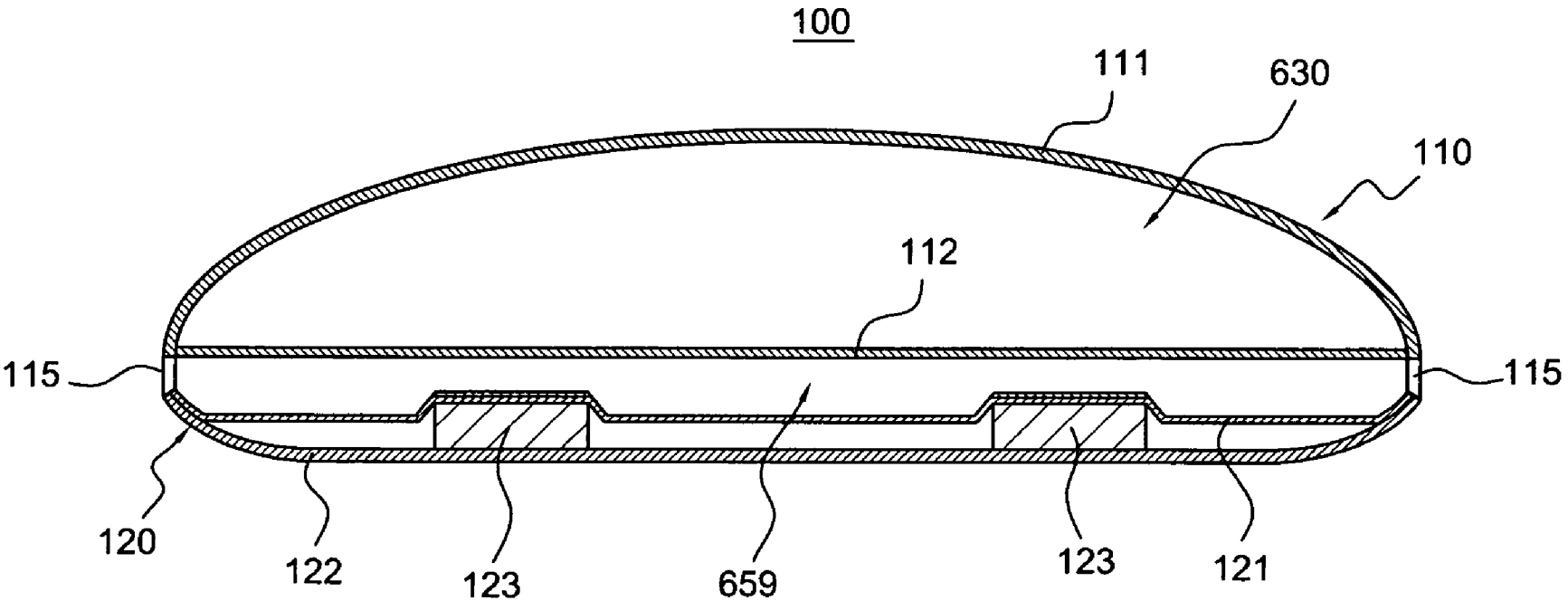
FIG. 6 illustrates a cross-sectional view along line 6-6 (FIG. 4) of the computer case of FIG. 1, according to the first embodiment.

Turning to the drawings, FIG. 1 illustrates an exploded view of a computer case 100, according to a first embodiment. FIG. 2 illustrates a front, right isometric view of computer case 100 in an open position, according to the first embodiment. FIG. 3 illustrates a front, right isometric view of computer case 100 in the open position with a portable computer 350 located within computer case 100, according to the first embodiment. FIG. 4 illustrates a right, top isometric view of computer case 100 in a closed position, according to the first embodiment. FIG. 5 illustrates a left, bottom isometric view of computer case 100 in the closed position, according to the first embodiment. FIG. 6 illustrates a cross-sectional view along line 6-6 (FIG. 4) of case 100, according to the first embodiment. It should be understood that case 100 is merely exemplary and that the present invention may be employed in many different cases not specifically depicted herein.

As illustrated in FIGS. 1-6, computer case 100 can be configured to hold a portable computer 350 (FIG. 3) and allow a user to type on a keyboard 351 (FIG. 3) of computer 350 while computer 350 is inside of case 100. As an example, case 100 can be a clamshell structure and include: (a) a bottom casing or base shell 120; (b) a top casing or cover shell 110; (c) a hinge 140; (d) one or more support straps 141; and (e) a closure mechanism 115. In some examples, cover shell 110 and base shell 120 have a non-conformal shape around computer 350.

In some embodiments, cover shell 110 is coupled to base shell 120 and configured to move between a closed position relative to base shell 120, in which a user cannot type on keyboard 351 while computer 350 is inside of case 100, and an open position relative to base shell 120, in which the user can type on keyboard 351 while computer 350 is inside of case 100. For example, when cover shell 110 is in the open position, the edges of base shell 120 are lower than the top surface of keyboard 351(FIG. 3) to allow a user to use computer 350 (FIG. 3).

In various examples, case 100 is asymmetric in shape when cover shell 110 is in the closed position relative to base shell 120. In many embodiments, base shell 120 is pivotally coupled to cover shell 110 by hinge 140. In non-illustrated embodiments, at least two of hinge 140, base shell 120, and cover shell 110 are integrally formed with each other.

In the same or different embodiments, base shell 120 and cover shell 110 can also be coupled together by support straps 141. Each of support straps 141 has an end 142 and an end 143 opposite end 142. End 142 of each of support straps 141 can be coupled to the cover shell 110 inside of case 100. Similarly, end 143 of each of support straps 141 can be coupled to base shell 120 inside of case 100. In other examples, ends 142 and 143 are sewn to cover shell 110 and base shell 120, respectively. In some embodiments, other attachment mechanisms, such as Velcro® material, buttons, string ties, or the like can be used in place of or in addition to support straps 141 to couple together cover shell 110 and base shell 120.

In some examples, support straps 141 are configured to limit the movement of cover shell 110 relative to base shell 120. In one embodiment, support straps 141 limit the angle between the interior of cover shell 110 and the interior of base shell 120. In one example, support straps 141 limit the angle to 110 degrees.

In one embodiment, each of support straps 141 are formed by sewing together a strap 262 (FIG. 2) and a strap 263 (FIG. 2). The stitching in the center of support straps 141 acts as a hinge and allows support straps 141 to fold inward when case 100 is placed into the closed position.

In some examples, closure mechanism 115 can couple cover shell 110 to base shell 120. In one embodiment, closure mechanism 115 couples an outer edge 216 (FIG. 2) of base shell 120 to an outer edge 217 (FIG. 2) of cover shell 110. Closure mechanism 115 can securely hold case 100 in the closed position, but can also be opened or removed to allow access to the interior of case 100. In one embodiment, closure mechanism 115 is a zipper assembly. In other embodiments, other attachment mechanisms, such as Velcro® material, buttons, string ties, or the like, can be used instead of or in addition a zipper for closure mechanism 115.

In one example, base shell 120 can include: (a) a panel 121 with a side 144 and a side 145 opposite side 144; (b) a panel 122; and (c) one or more pads 231 (FIG. 2) extending from side 144 and positioned such that a bottom of computer 350 is capable of resting on pads 231 (FIG. 2).

In some examples, as illustrated in FIG. 1, pads 231 (FIG. 2) can include: (a) one or more raised portions 126 of panel 122 with each one of raised portions 126 have a top surface 127 and a bottom surface (not shown) opposite top surface 127; (b) one or more portions 125 located adjacent to top surface 127; and (c) one or more internal supports 123 located adjacent to the bottom surface of raised portions 126. In some examples, internal supports 123 are located between panel 121 and panel 122. In various examples, portions 125 are non-skid pads. In one embodiment, portions 125 are formed from a molded elastomer.

When computer 350 (FIG. 3) is placed inside of case 100, pads 231 are positioned such that the bottom of computer 350 rests at portions 125. When the bottom of computer 350 is resting on pads 231, computer 350 is elevated above panel 121, and ventilation for a cooling system (e.g. the fan) of computer 350 is provided. That is, pads 231 separate computer 350 from base shell 120 to create an air gap (not shown) therebetween. Accordingly, heat can dissipate from computer 350 without passing through base shell 120.

As illustrated in FIG. 2, pads 231 have an end 278 and an end 279 opposite end 278. End 279 can be closer to hinge 140 than end 278. In some embodiments, a height 276 of pads 231 at end 278 is less than a height 277 of pads 231 at end 279. In one example, height 276 can be approximately ten millimeters above side 144 of panel 121 and height 277 can be approximately nineteen millimeters above side 144 of panel 121. In one embodiment, an incline plane is formed by the varying height of pads 231 between ends 278 and 279. For example, the top side of pads 231 can be sloped at an angle of approximately three degrees between ends 278 and 279. When computer 350 is placed on pads 231, keyboard 351 is sloped upward from front to back to allow a more ergonomic position of a user's hands on keyboard 351. Other heights, angles, and slopes are contemplated herein.

In alternative embodiments, the height of pads 231 does not vary between ends 131 and 132. In these embodiments, the pads can have a height of 15 millimeters, for example.

Returning back to FIG. 1, internal supports 123 can have an end 151 and an end 152 opposite end 151. End 152 can be closer to hinge 140 than end 151. In some embodiments, a height of internal supports 123 at end 151 is less than a height of internal supports 123 at end 152. The heights of portions 125 and raised portions 126 can be constant such that internal supports 123 provide the angle or slope of pads 231 described above.

Panel 122 can be coupled to panel 121. In some embodiments, an edge 118 of panel 121 is coupled to an edge 119 of panel 122. For example, stitching around edge 118 and edge 119 can be used to couple together panels 121 and 122. In another example, an adhesive can be used to couple together panels 121 and 122. In a further embodiment, panel 122 and panel 121 are a single panel. In one example, panel 122 can be formed from molded EVA (ethylene-vinyl acetate) and can have a cloth fabric (e.g., polyester) cover at the exterior side of panel 122 and case 100. Panel 121 can also be formed from molded EVA and have a cloth fabric cover at side 144.

Cover shell 110 can include: (a) a panel 112; and (b) a panel 111. Panel 112 can be coupled to panel 111 such that a pocket 630 (FIG. 6) is located or formed between panel 111 and panel 112. In one example, an edge 149 of panel 112 is sewn to an edge 148 of panel 111 to form pocket 630 (FIG. 6). Pocket 630 provides an interior space within case 100 where wires, power adapters, cords, cables, peripherals, and the like can be stored.

To allow a user easy access to the items stored in pocket 630 (FIG. 6), panel 111 can have at least one opening 135 into pocket 630 (FIG. 6). Likewise, panel 112 can have at least one opening 136 into pocket 630 (FIG. 6).

In some embodiments, opening 136 can be used to thread cables, wires, cords, or the like from pocket 630 (FIG. 6) to computer 350 (FIG. 3). In some examples, opening 136 can be sized to allow one or more cables, wires, cords, or the like to pass simultaneously through opening 136. Opening 136 can be circular and have a diameter of approximately thirty millimeters in one example. In other examples, opening 136 can have other shapes and sizes.

Additionally, opening 136 can be adjacent to or covered by a cable grommet 139. Other than improving the aesthetics of case 100, cable grommet 139 can help hold and organize cables, cords, wires and the like running through opening 136.

Opening 135 can be a larger opening than opening 136 and give the user full access to pocket 630 (FIG. 6) through panel 111. In one example, opening 135 can have a length of approximately 181 millimeters and width of approximately 60 millimeters. Other dimensions are also contemplated.

Opening 135 can also be configured to be used with an indention or handle portion 537 (FIG. 5) of panel 122 to carry case 100. When case 100 is in a closed position, a user can place his four fingers inside of opening 135 and his thumb against handle portion 537 (FIG. 5) to carry case 100. In one embodiment, the portion of panel 111 around opening 135 is lined with a rim 153 to reinforce opening 135 and improve the aesthetics of case 100. Furthermore, to support the increased weight and pressure placed on opening 135 of panel 111 when opening 135 is used as a handle, a reinforcement and/or padding element 138 can be coupled to the interior side of panel 111 around or near opening 135.

In one embodiment, panel 111 can be formed from molded EVA and have a cloth fabric on the exterior side of panel 111 and case 100. Panel 112 can also be formed from molded EVA and have a cloth fabric on the interior side of panel 112 facing towards panel 121.

As shown in FIG. 6, in some embodiments, case 100 can be considered to include: (a) a compartment 659 between panels 112 and 121; and (b) a compartment or pocket 630 between panels 111 and 112 and adjacent to compartment 659 and having an opening 135 (FIG. 1). In some embodiments, compartment 659 is formed by panel 112, panel 121, hinge 140, and closure mechanism 115. Compartment 659 can be designed to allow one or more cords, wires, cables, or the like to be coupled to computer 350 without requiring the cords or wires to extend outside of case 100 when computer 350 is located within compartment 659.

In some examples, compartment 659 is designed to be, sealable. For example, compartment 659 can be sealed using closure mechanism 115. Pocket 630 can be designed to remain open (i.e. opening 135 does not have a cover or closure mechanism). Compartment 659 can be accessible through pocket 630. In one example, compartment 659 can be accessed from pocket 630 through opening 136 (FIG. 1).

Compartment 659 can be sized to fit a laptop computer, such as computer 350. Pocket 630 can be sized to hold at least a power cord and a transformer for the laptop computer. In the illustrated embodiment, pocket 630 is larger than compartment 659. In alternative embodiments, compartment 659 is larger than or approximately the same size as pocket 630.

Figure 7:
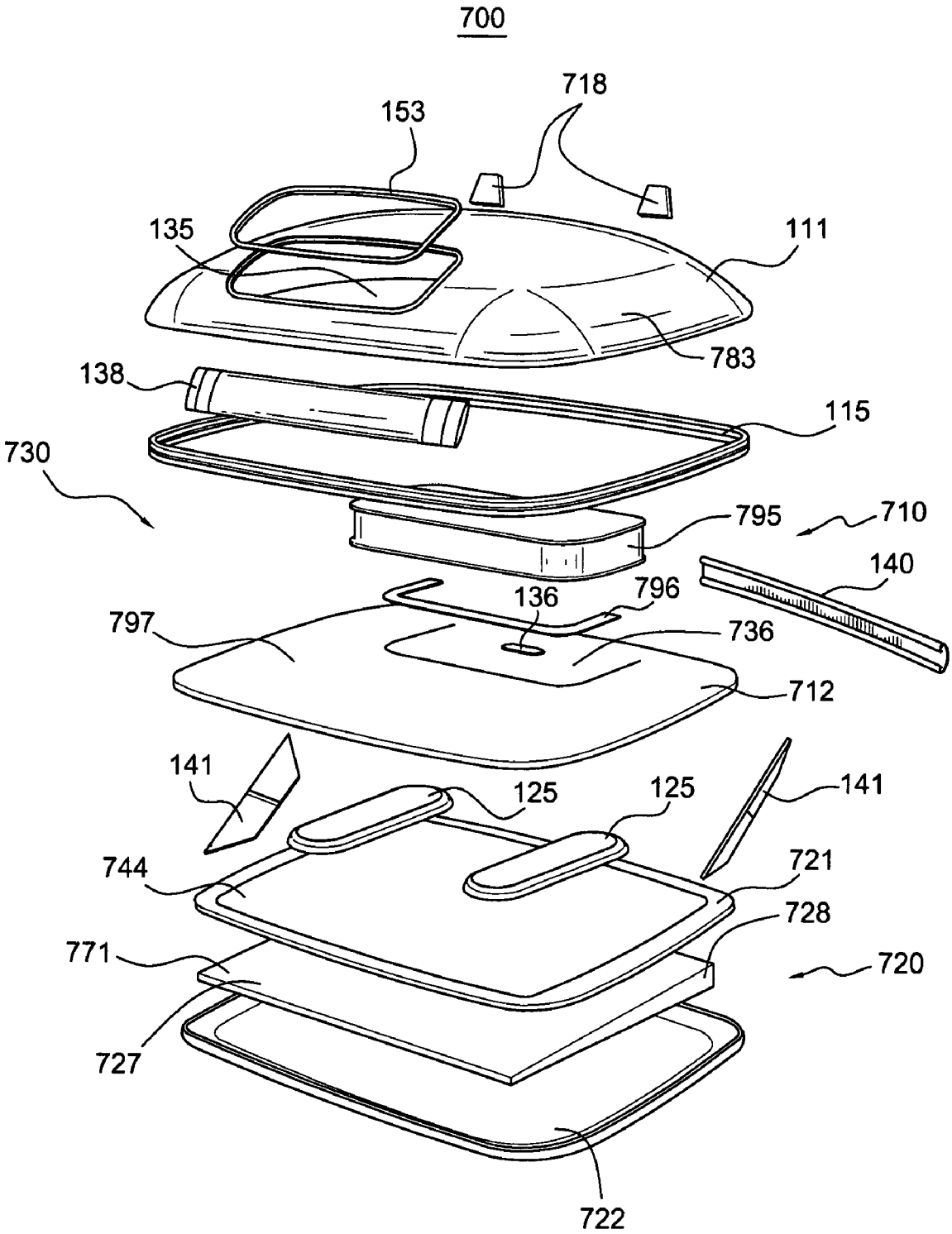
FIG. 7 illustrates an exploded view of a computer case, according to a second embodiment.
Figure 8:
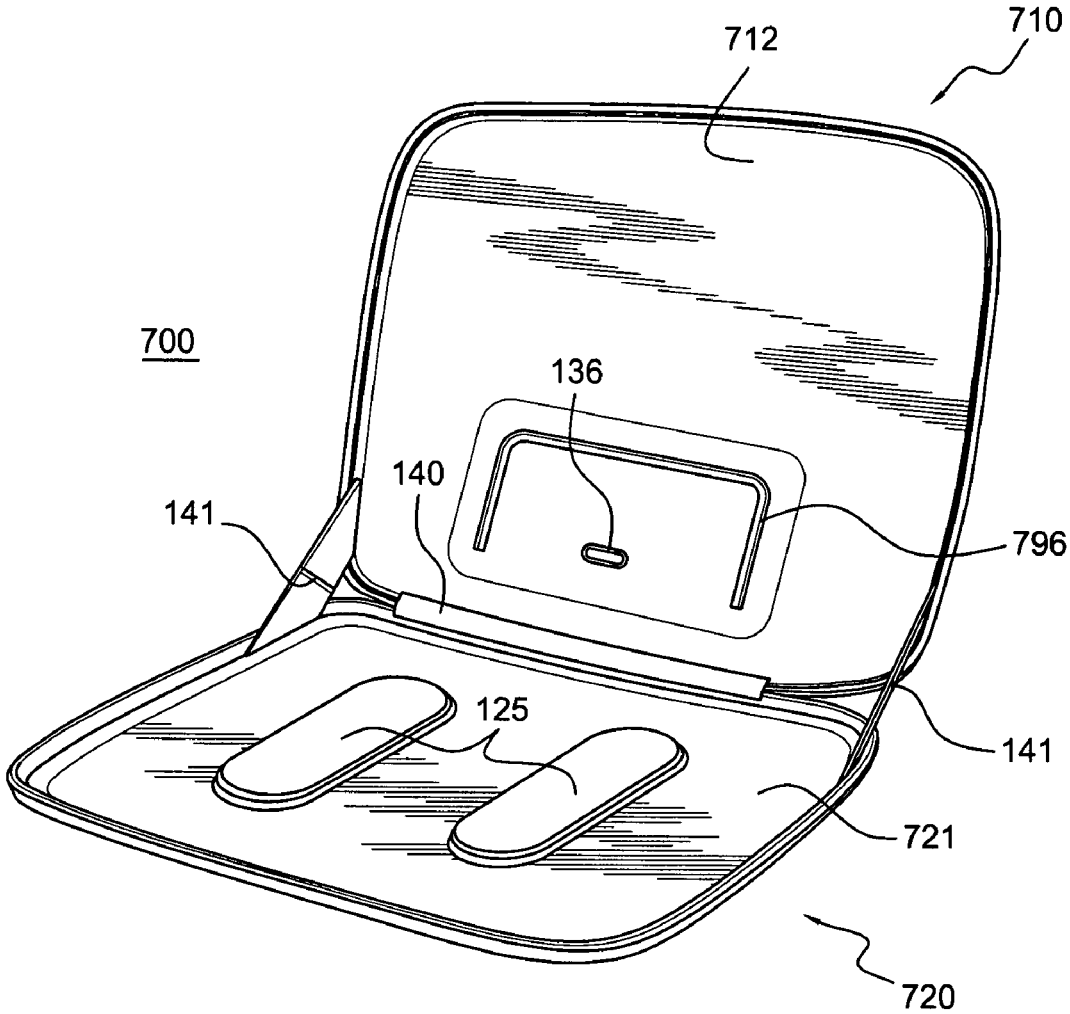
FIG. 8 illustrates a front, right isometric view of the computer case of FIG. 7 in an open position, according to the second embodiment.

FIG. 7 illustrates an exploded view of a computer case 700, according to a second embodiment. FIG. 8 illustrates a front, right isometric view of computer case 700 in an open position, according to the second embodiment. Similar to case 100 (FIGS. 1-6), case 700 is configured to hold computer 350 (FIG. 3) and allow a user to type on keyboard 351 (FIG. 3) of computer 350 while computer 350 is inside of case 700.

As an example, case 700 can include: (a) a base shell 720; (b) a cover shell 710; (c) hinge 140; (d) support straps 141; and (e) closure mechanism 115.

In some embodiments, base shell 720 can include: (a) a panel 721 with an exterior surface 744; (b) a panel 722; (c) a panel 771; and (d) portions 125 at exterior surface 744. In some examples, panel 721 and panel 722 are identical to or similar to panels 121 and 122, respectively, except that panel 722 does not have any raised portions 126 (FIG. 1).

Panel 771 is located between panel 721 and 722. In some embodiments, panel 771 can be a foam pad or some other type of material capable of absorbing a mechanical shock. In one example, panel 771 has an end 727 and an end 728 opposite end 727 with end 728 is closer to hinge 140. In this example, the height of panel 771 at end 727 can be less than the height of panel 771 at end 728. The height of panel 771 can be varied such that an inclined plane is formed and such that the front end of panel 721 is lower than the back end of panel 721. Thus, when computer 350 (FIG. 3) is placed in case 100, keyboard 351 (FIG. 3) is sloped upward from front to back to allow a more ergonomic positioning of the user's hands on keyboard 351 (FIG. 3).

In other embodiments, case 700 does not include a panel 771. In yet still further embodiments, a foam pad or other shock absorbing material is incorporated into panels 721 and/or 722, and panel 771 is eliminated.

In one embodiment, cover shell 710 can include: (a) a panel 712 with an opening 736 and an interior surface 797; (b) a panel 111; and (c) a pocket or pocket assembly 795. In some embodiments, panel 712 can be identical to or similar to panel 112 (FIG. 1) except opening 736 differs from opening 136 (FIG. 1). In alternative embodiments, panel 712 is identical to panel 112 (FIG. 1). Panel 111 and panel 712 can form a compartment 730 in addition to or as a replacement for pocket assembly 795. Compartment 730 can be similar to compartment 630 (FIG. 6).

In one example, panel 712 is coupled to panel 111 with pocket assembly 795 located between panel 712 and panel 111. In some embodiments, pocket assembly 795 can include an opening (not shown) into compartment 730. Pocket assembly 795 can be located adjacent to interior surface 797 and opening 736. In some embodiments, opening 736 can be a U-shaped laceration in panel 712 with a mechanism 796 to hold opening 736 closed. For example, a zipper or Velcro® material can be used to close the U-shaped laceration. In the same or different embodiment, a portion of panel 712 can be formed of a vented material (e.g., mesh) to allow heat to dissipate through opening 736 into pocket assembly 795 and out of case 700.

In some embodiments, panel 111 can include or be adjacent to one or more feet 718 at an exterior surface 783. Feet 718 can be used to help hold case 700 upright when the case in the closed position and leaning against a wall. In one example, feet 718 are formed from a hard polyurethane.

Figure 9:
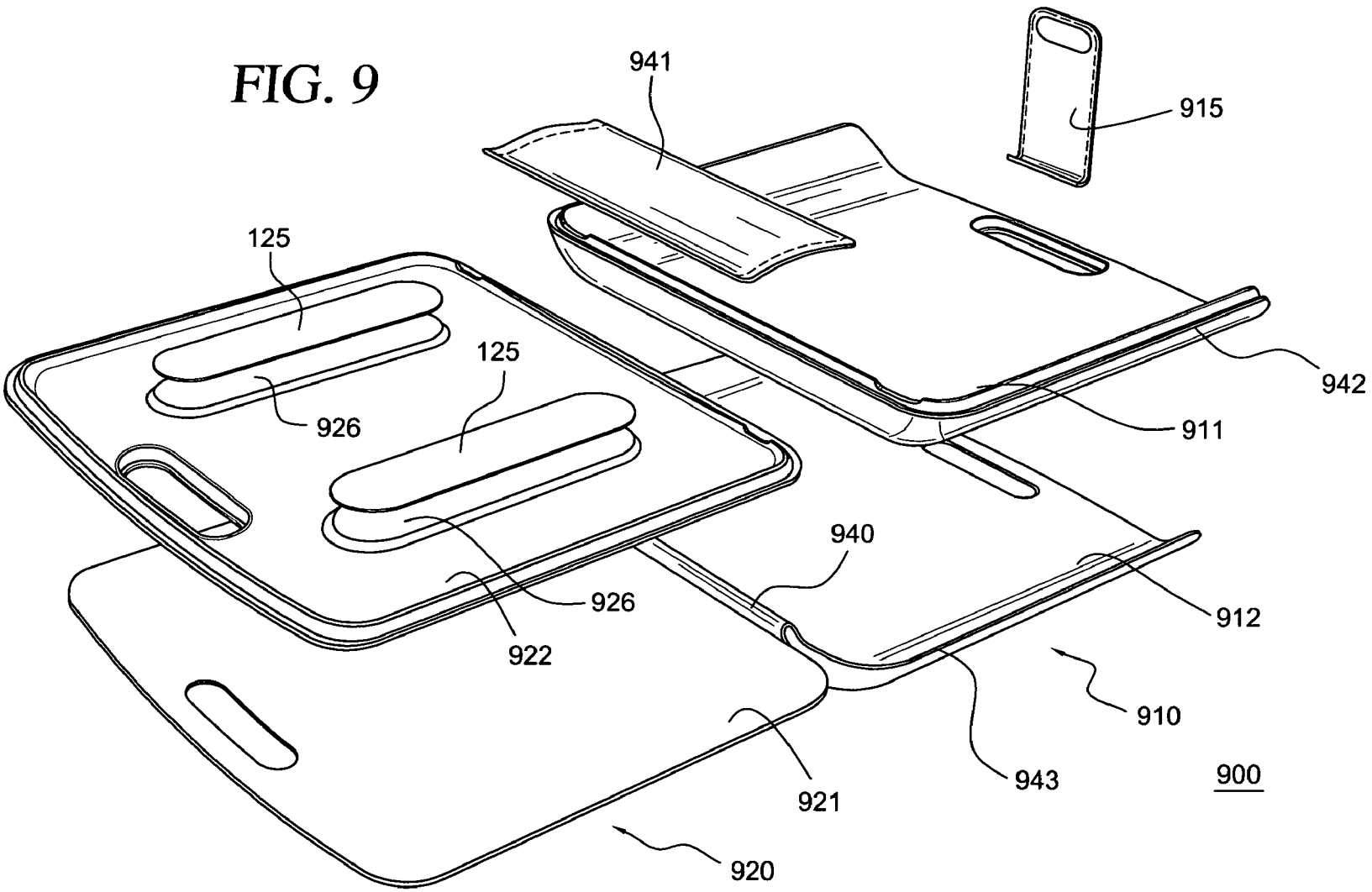
FIG. 9 illustrates an exploded view of a computer case, according to a third embodiment.
Figure 10:
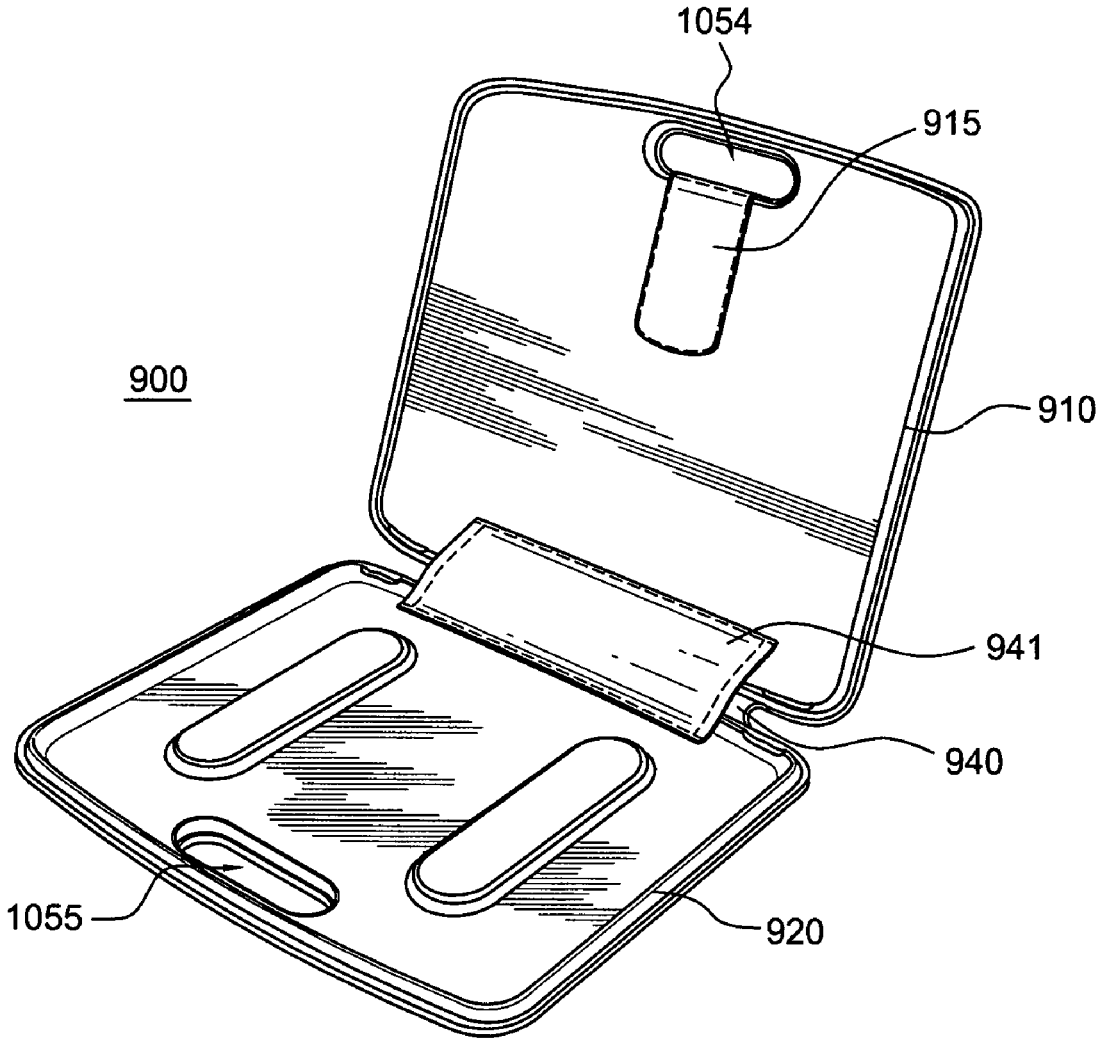
FIG. 10 illustrates a front, right isometric view of the computer case of FIG. 9 in an open position, according to the third embodiment.
Figure 11:
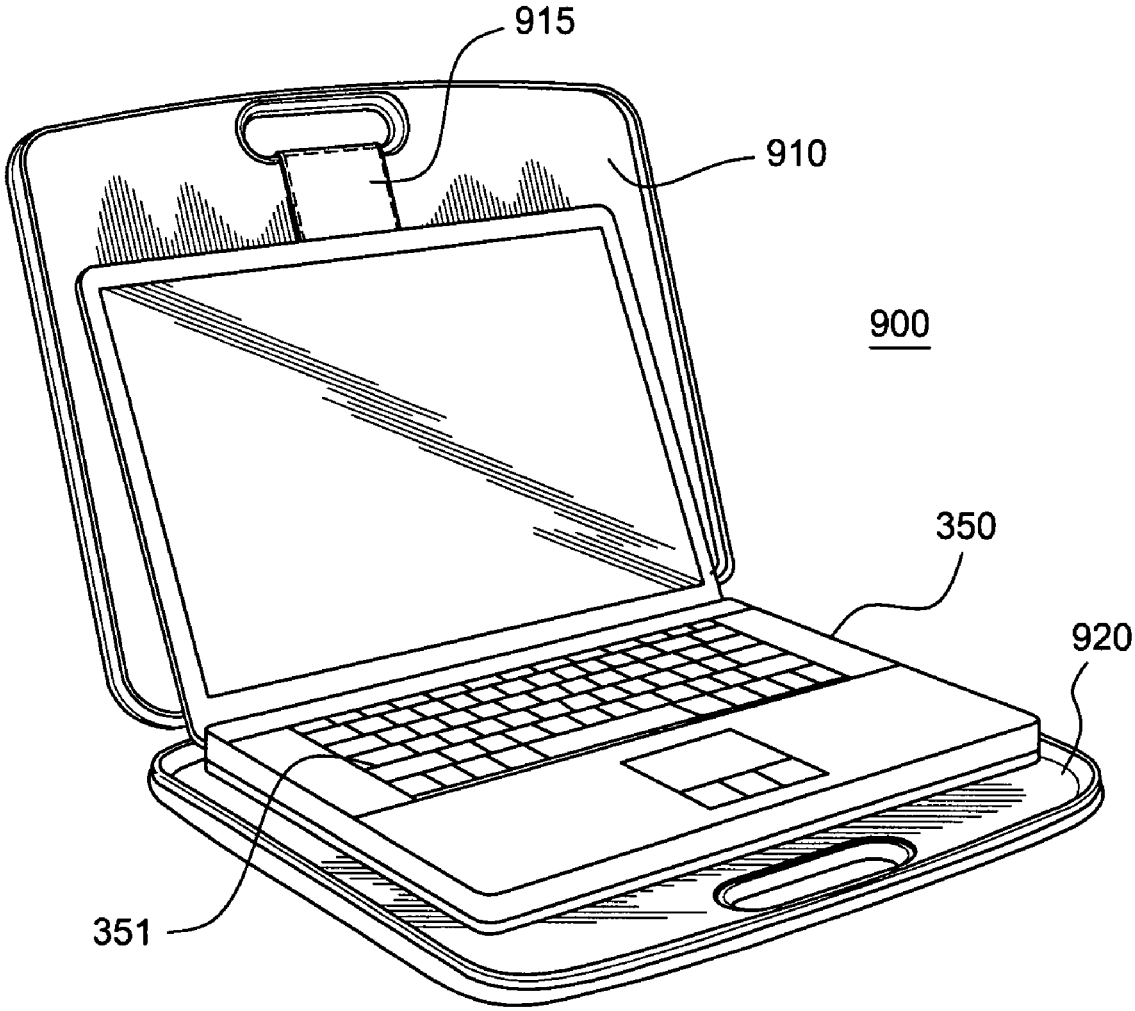
FIG. 11 illustrates a front, left isometric view of the computer case of FIG. 9 in the open position with a portable computer located within the computer case of FIG. 9, according to the third embodiment.
Figure 12:
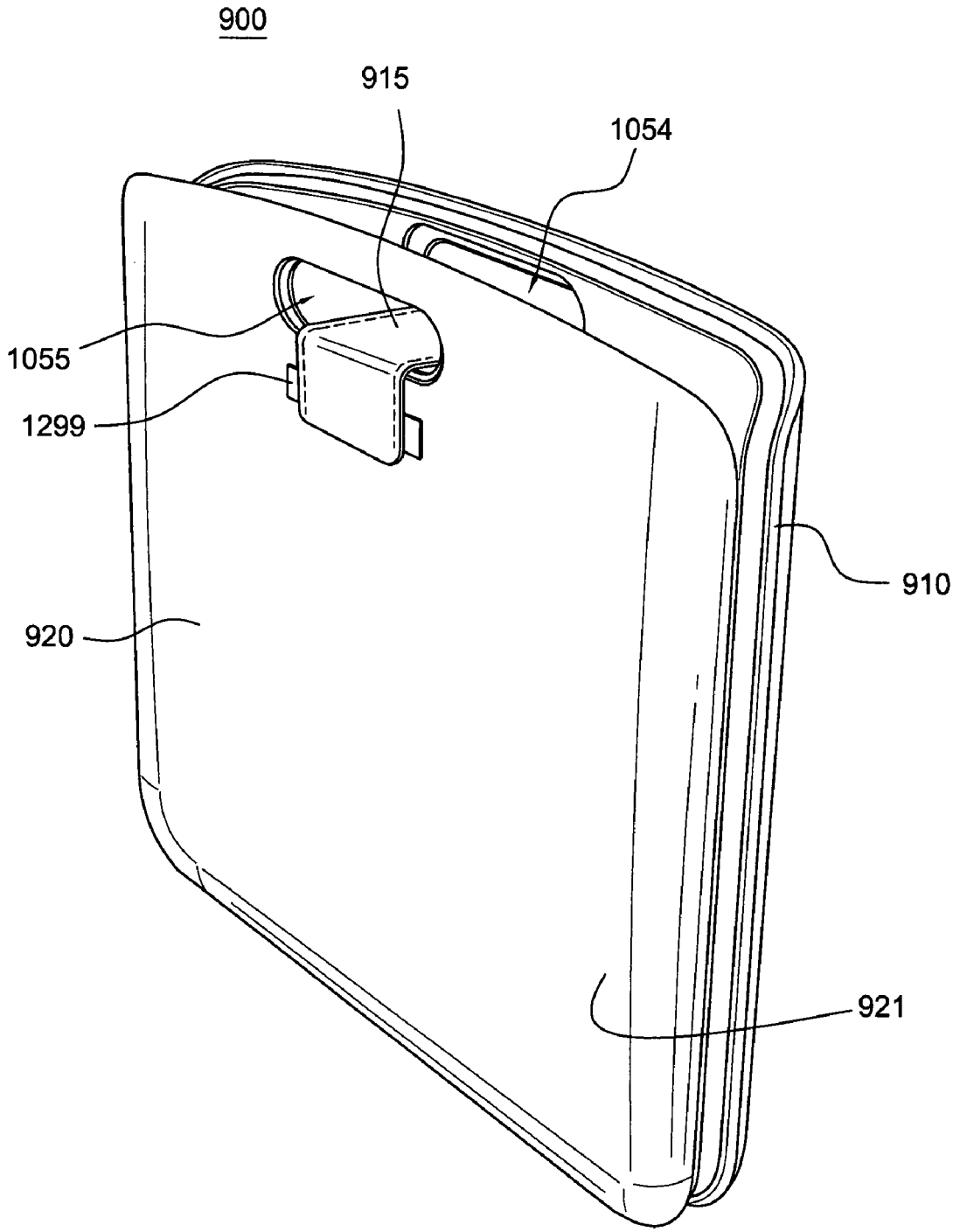
FIG. 12 illustrates a right, bottom isometric view of the computer case of FIG. 9 in a closed position, according to the third embodiment.

Turning to further embodiments, FIG. 9 illustrates an exploded view of a computer case 900, according to a third embodiment. FIG. 10 illustrates a front, right isometric view of computer case 900 in an open position, according to the third embodiment. FIG. 11 illustrates a front, left isometric view of computer case 900 in the open position with computer 350 located inside of computer case 900, according to the third embodiment. FIG. 12 illustrates a right, bottom isometric view of computer case 900 in a closed position, according to the third embodiment.

Similar to case 100 (FIG. 1), case 900 is configured to hold computer 350 and allow a user to type on keyboard 351 of computer 350 while computer 350 is inside of case 900. As an example, case 900 can include: (a) a base shell 920; (b) a cover shell 910; (c) a hinge 940; (d) at least one support strap 941; and (e) a closure mechanisms 915 and 1299 (FIG. 12). When case 900 is the open position, the edges of base shell 920 are lower than keyboard 351 (FIG. 3) to facilitate use of computer 350 (FIG. 3). Base shell 920 and cover shell 910 can be pivotally coupled by hinge 940. In the illustrated embodiment, base shell 920, cover shell 910, and hinge 940 are integrally formed. In the same or different embodiments, base shell 920 can have an opening 1055 (FIG. 10), and cover shell 910 can have an opening 1054 (FIG. 10). In some examples, opening 1054 and 1055 in combination with cover shell 910 and base shell 920 can function as a handle for case 900.

In one embodiment, cover shell 910 includes: (a) a panel 911; and (b) a panel 912. Panels 911 and 912 can be coupled together by sewing in one example. In the same or different embodiment, base shell 920 includes: (a) a panel 921; and (b) a panel 922. Panels 921 and 922 can be coupled together by sewing panel 921 to panel 922. In one example, panel 922 can include one or more raised portions 926. Raised portions 926 can be coupled to and extend from panel 922 in one embodiment. Portions 125 can be coupled to raised portions 926 and arranged such that computer 350 is capable of being placed on portions 125.

Closure mechanism 1299 (FIG. 12) can be adjacent to an exterior of the base shell 920. Case 900 can be secured in the closed position by coupling closure mechanism 915 to closure mechanism 1299. In one example, closure mechanism 915 is a cloth flap with a Velcro hook patch and closure mechanism 1299 is a Velcro loop patch. Closure mechanism 915 can be coupled to cover shell 910 by sewing one end of the cloth flap between panel 911 and panel 912. In one embodiment, closure mechanism 915 can be coupled to closure mechanism 1299 through openings 1054 and 1055.

In some examples, panel 911 and/or panel 912 can include curved edge sections 942 and 943, respectively. When case 900 is in the closed position, curved edge sections 942 and 943 can prevent computer 350 from sliding out of case 900.

In some embodiments, hinge 940 pivotally couples panel 921 to panel 912, and support strap 941 couples panel 922 to panel 911. Support strap 941 can be configured to limit the movement of cover shell 910 relative to base shell 920. In one example, when case 900 is in the open position, support strap 941 can limit the angle between cover shell 910 and base shell 920 to 110 degrees.

Figure 13:
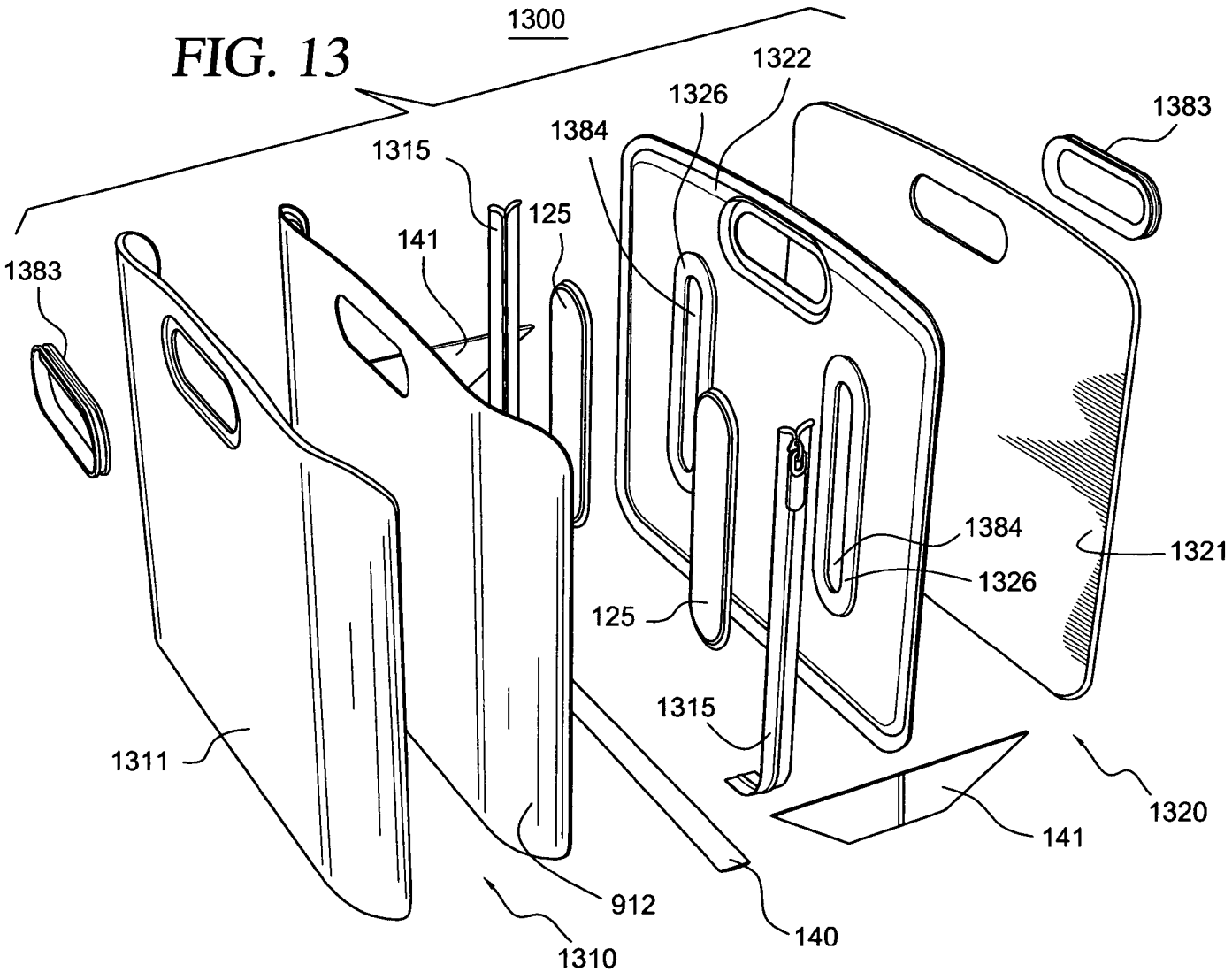
FIG. 13 illustrates an exploded view of a computer case, according to a fourth embodiment.
Figure 14:
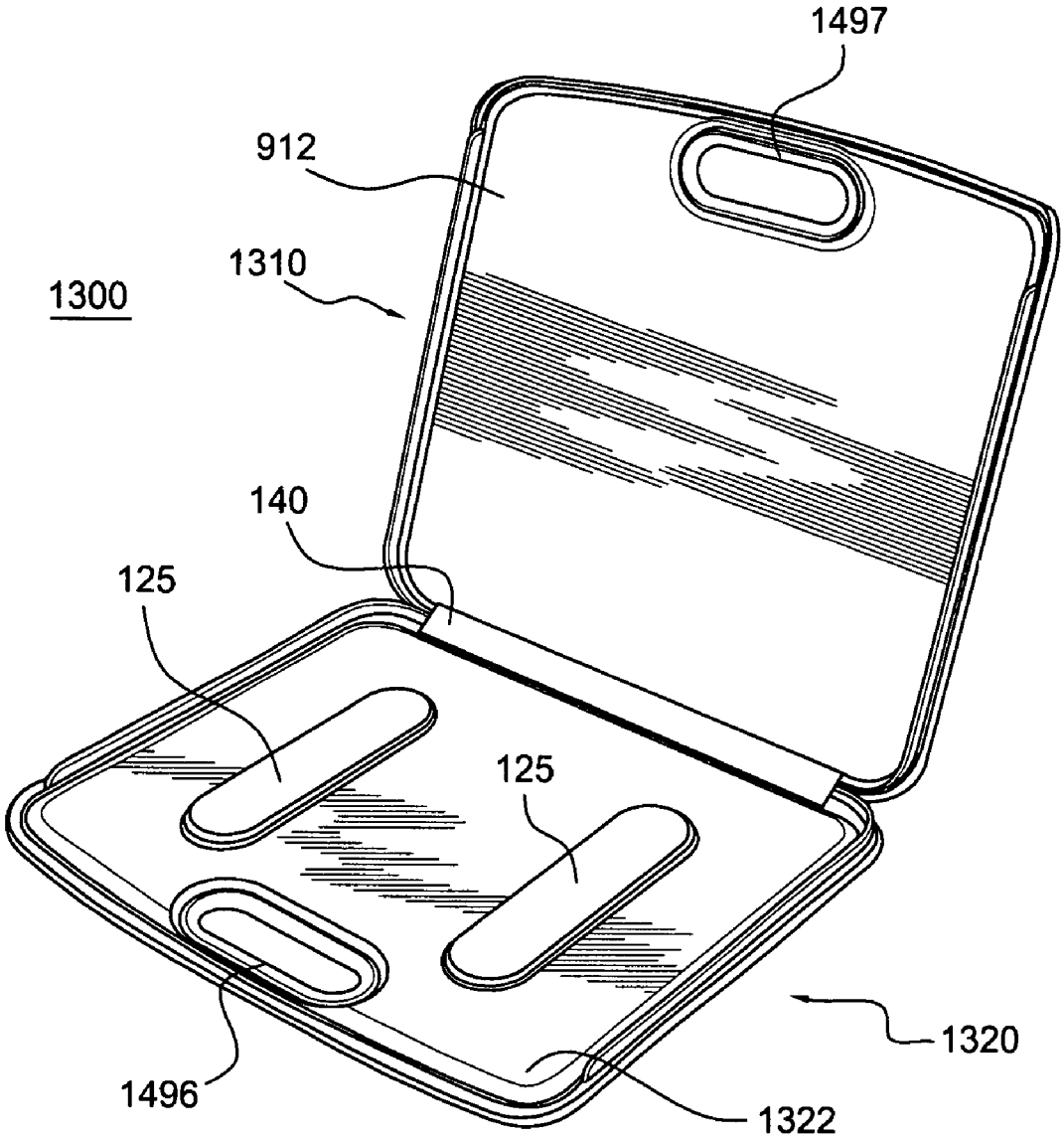
FIG. 14 illustrates a front, right isometric view of the computer case of FIG. 13 in an open position, according to the fourth embodiment.

FIG. 13 illustrates an exploded view of a computer case 1300, according to a fourth embodiment. FIG. 14 illustrates a front, right isometric view of computer case 1300 in an open position, according to the fourth embodiment. Similar to cases 100 (FIG. 1), case 700 (FIG. 7), and case 900 (FIG. 9), case 1300 is configured to hold computer 350 (FIGS. 3 and 11) and allow a user to type on keyboard 351 (FIGS. 3 and 11) of computer 350 (FIGS. 3 and 11) while computer 350 (FIGS. 3 and 11) is inside of case 1300.

As an example, case 1300 can include: (a) a base shell 1320; (b) a cover shell 1310; (c) hinge 140; (d) support straps 141; and (e) two closure mechanisms 1315, which can be similar to closure mechanism 115 (FIG. 1). Base shell 1320 and cover shell 1310 can be pivotally coupled together by hinge 140. Base shell 1320 and cover shell 1310 can have handle supports 1383 located around the edges of handles 1496 and 1497 (FIG. 14). In some examples, handle support 1383 can help strength and support handles 1496 and 1497 (FIG. 14).

In some embodiments, cover shell 1310 includes: (a) a panel 1311; and (b) panel 912. In the same or different embodiments, base shell 1320 can include: (a) a panel 1321; and (b) a panel 1322. Panels 1311 and 1321 can be identical or similar to panels 911 and 912, respectively (FIG. 9), except that panels 1311 and 1321 are not integrally formed with hinge 140. Moreover, panel 1322 can be identical or similar to panel 922 (FIG. 9) except that extension portions 1326 have one or more apertures 1384. Apertures 1384 can help disperse heat from computer 350.

Figure 15:
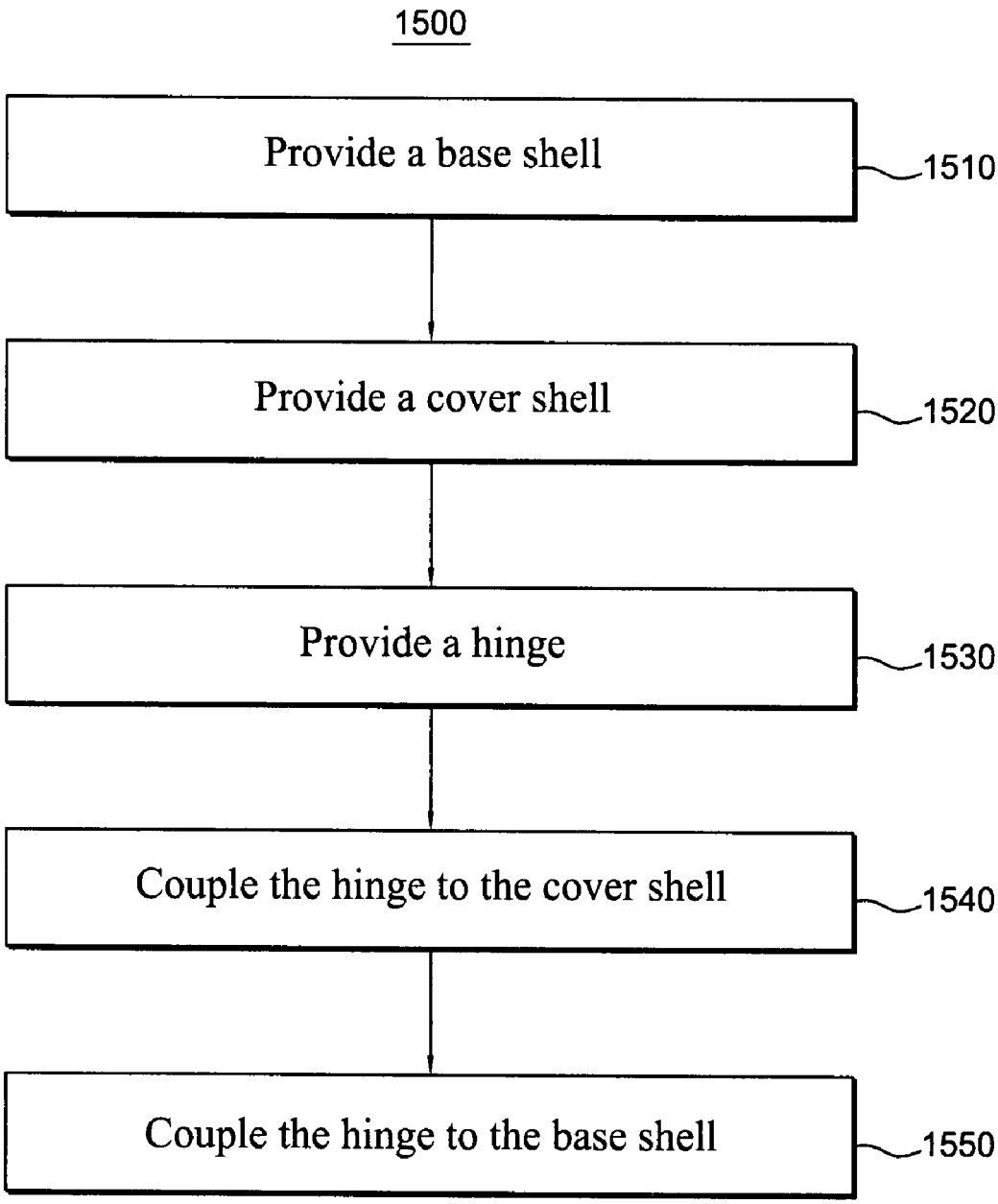
FIG. 15 illustrates a flow chart for a method of manufacturing a case configured to hold a portable computer, according to an embodiment.

FIG. 15 illustrates a flow chart 1500 for a method of manufacturing a case configured to hold a portable computer, according to an embodiment. In some examples, the case can be identical to or similar to case 100, 700, 900, or 1300 of FIGS. 1, 7, 9, or 13, respectively.

Flow chart 1500 of FIG. 15 includes an action 1510 of providing a base shell. For example, the base shell can be identical to or similar to base shell 120, 720, 920, or 1320 of FIGS. 1, 7, 9, or 13, respectively.

Flow chart 1500 of FIG. 15 continues with an action 1520 of providing a cover shell. For example, the cover shell can be identical to or similar to cover shells 110, 710, 910, or 1310 of FIGS. 1, 7, 9, or 13, respectively. Actions 1510 and 1520 can be also performed in revised order or simultaneously with each other.

Figure 16:
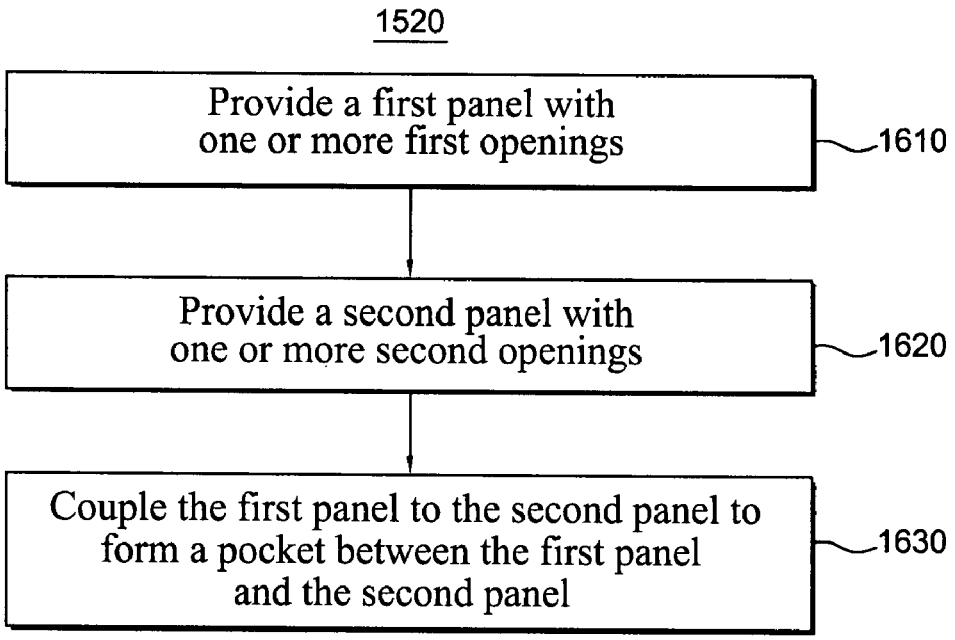
FIG. 16 illustrates a flow chart for an action of providing a cover shell, according to an embodiment.

FIG. 16 illustrates a flow chart of an exemplary embodiment for action 1520 of providing a cover shell. Action 1520 of FIG. 16 includes a procedure 1610 of providing a first panel with one or more first openings. For example, the first panel with one or more first openings can be identical to or similar to panels 112 or 712 of FIGS. 1 and 7, respectively.

Action 1520 of FIG. 16 continues with a procedure 1620 of providing a second panel with one or more second openings. The second panel with one or more second openings can be identical to or similar to panels 111 of FIGS. 1 and 7, respectively.

Next, action 1520 of FIG. 16 includes a procedure 1630 of coupling the first panel to the second panel to form a pocket between the first panel and the second panel. The pocket can be identical to or similar to pocket 630 of FIG. 6 of pocket 730 of FIG. 7.

Referring back to FIG. 15, flow chart 1500 continues with an action 1530 of providing a hinge. In some examples, the hinge can be identical to or similar to hinge 140 or 940 of FIGS. 1 and 9, respectively.

Next, flow chart 1500 of FIG. 15 includes an action 1540 of coupling the hinge to the cover shell. In one example, the hinge can be coupled to the cover shell in a manner identical to or similar to the coupling of hinge 140 to cover shell 110, as illustrated in FIG. 1, or the coupling of hinge 140 to cover shell 710, as illustrated in FIG. 7. Furthermore, the coupling can be identical or similar to the coupling of hinge 940 to cover shell 910, as illustrated in FIG. 9, or the coupling of hinge 140 to cover shell 1310, as illustrated in FIG. 13.

Subsequently, flow chart 1500 of FIG. 15 includes an action 1550 of coupling the hinge to the base shell. In one example, the hinge can be coupled to the base shell in a manner identical to or similar to the coupling of hinge 140 to base shell 120 as illustrated in FIG. 1 or the coupling of hinge 140 to base shell 720 as illustrated in FIG. 7. Furthermore, the coupling can be identical or similar to the coupling of hinge 940 to base shell 920, as shown in FIG. 9, or the coupling of hinge 140 to base shell 1320, as illustrated in FIG. 13. In one embodiment, actions 1510, 1520, 1530, 1540, and 1550 are performed simultaneously with each other, as in the embodiment of FIGS. 9-12. In another embodiment, the sequence of actions 1540 and 1550 is reversed. Other variations to the sequence of actions are also contemplated.

Figure 17:
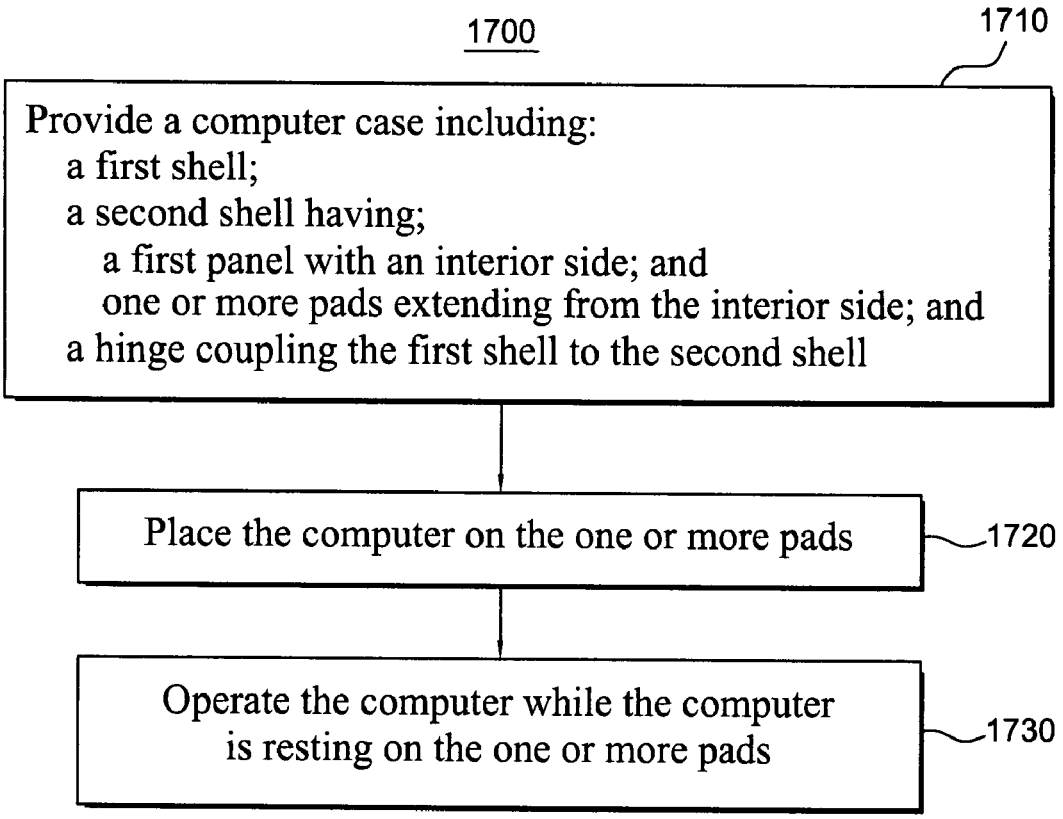
FIG. 17 illustrates a flow chart for a method of operating a computer, according to an embodiment.

FIG. 17 illustrates a flow chart for a method of operating a computer, according to an embodiment. Flow chart 1700 of FIG. 17 includes an action 1710 of providing a computer case including; (a) a first shell; (b) a second shell having: (1) a first panel with an interior side; and (2) one or more pads extending from the interior side; and (c) a hinge coupling the first shell to the second shell. In some examples, the case can be identical to or similar to cases 100, 700, 900, or 1300 of FIGS. 1, 7, 9, or 13, respectively.

Flow chart 1700 of FIG. 17 includes an action 1720 of placing the computer on the one or more pads. The computer can be placed on the one or more pads in a manner identical to or similar to the placement of computer 350 on the pads as shown in FIG. 3 or 11.

Subsequently, flow chart 1700 of FIG. 17 includes an action 1730 of operating the computer while the computer is resting on the one or more pads.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the system discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention. As one specific non-limiting example, each of base shells 120, 720, 920, and 1320 in FIGS. 1, 7, 9, and 13, respectively can comprise a single panel.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A case configured to hold a portable computer with a keyboard, the case comprising:

a base shell comprising:

a base panel with a first side; and one or more pads extending from the first side and positioned such that a bottom of the portable computer is capable of resting on the one or more pads; and a cover shell coupled to the base shell and configured to move between a first position relative to the base shell, in which a user cannot type on the keyboard of the portable computer while the portable computer is inside of the case, and a second position relative to the base shell, in which the user can type on the keyboard of the portable computer while the portable computer is inside of the case, wherein:

the cover shell comprises:

an outer cover panel; and an inner cover panel coupled to the outer cover panel;

the cover shell has a pocket located between the outer cover panel and the inner cover panel;

the outer cover panel has one or more first apertures into the pocket; and the inner cover panel has one or more second apertures into the pocket.

2. The case of claim 1, wherein:

the one or more pads comprises one or more raised portions; and the one or more raised portions are part of the base panel.

3. The case of claim 1, wherein:

the base shell has a first end and a second end opposite the first end; and a height of the base shell at the first end is less than a height of the base shell at the second end.

4. The case of claim 1, wherein:

the base panel has a second side opposite the first side; and the base shell further comprises:

an outer base panel coupled to the second side of the base panel.

5. The case of claim 4, wherein:

the one or more pads further comprise:

one or more internal support pads with a first end and a second end opposite the first end, the one or more internal support pads are located between the outer base panel and the base panel.

6. The case of claim 5, wherein:

a height of the one or more internal support pads at the first end is less than a height of the one or more internal support pads at the second end.

7. The case of claim 5, wherein:

each of the one or more internal support pads provides support to the portable computer.

8. The case of claim 1, wherein:

the one or more pads are configured to provide ventilation for a cooling system of the portable computer.

9. The case of claim 1, wherein:

one or more pads separate the portable computer from the base panel to create an air gap therebetween.

10. The case of claim 1, wherein:

the one or more pads have a first end and a second end opposite the first end; and a height of the one or more pads at the first end is less than a height of the one or more pads at the second end.

11. The case of claim 1, wherein:

a portion of one of the one or more first apertures of the outer cover panel is a portion of a handle for the case.

12. The case of claim 1, further comprising:

a hinge coupling the cover shell to the base shell.

13. The case of claim 1, further comprising:

one or more support straps within the case configured to limit the movement of the cover shell relative to the base shell.

14. The case of claim 1, wherein:

the case is asymmetric in shape when the cover shell is in the first position relative to the base shell.

15. The case of claim 1, further comprising:

one or more holes in the base shell.

16. A clamshell structure configured to contain a portable computer with a keyboard, the clamshell structure comprising:

a bottom casing;

a top casing comprising:

an outer top casing with one or more apertures; and an inner top casing with one or more apertures; and a hinge pivotally coupling together the top casing and the bottom casing such that a first compartment is formed therebetween, the first compartment configured to receive the portable computer, wherein:

the inner top casing is coupled to the outer top casing such that a pocket is formed between the outer top casing and the inner top casing;

the one or more apertures in the outer top casing open from an exterior of the clamshell structure into the pocket;

the one or more apertures in the inner top casing open from the first compartment into the pocket; and the clamshell structure is configured such that a user can use the keyboard of the portable computer while the portable computer is inside of the first compartment.

17. The clamshell structure of claim 16, wherein:

a portion of the bottom casing and one of the one or more apertures in the outer top casing are configured to be used in combination as a handle to carry the clamshell structure.

18. The clamshell structure of claim 17, wherein:

an outer portion of the bottom casing comprises an indentation; and the indention is part of the handle.

19. The clamshell structure of claim 16, wherein:

the bottom casing comprises:

an inner bottom casing; and one or more pads on the inner bottom casing and located such that the portable computer is capable of resting on the one or more pads.

20. The clamshell structure of claim 19, wherein:

the inner bottom casing and inner top casing have a non-conformal shape around the portable computer.

21. The clamshell structure of claim 16, further comprising:

one or more support straps, wherein:

each of the one or more support straps has a first end and second end opposite the first end;

the first end of each of the one or more support straps is coupled to the top casing inside the clamshell structure; and the second end of each of the one or more support straps is coupled to the bottom casing inside the clamshell structure.

22. The clamshell structure of claim 16, wherein:

at least one of the one or more apertures in the outer top casing opening into the pocket is sized to permit a transformer for the portable computer to enter into the pocket;

the one or more apertures in the inner top casing opening into the pocket is sized to permit a power cable from the transformers to run to the portable computer; and the one or more apertures in the inner top casing opening into the pocket are smaller than the one or more apertures in the outer top casing opening into the pocket.

23. A case comprising:

a first compartment; and a second compartment adjacent to the first compartment and having an opening at an exterior of the case, wherein:

the second compartment has an aperture into the first compartment;

the opening of the second compartment is a first portion of a handle for the case;

the second compartment is configured such that the opening in the second compartment provides access to the second compartment; and the second compartment is further configured such that the aperture in the second compartment provides access to the first compartment from the second compartment.

24. The case of claim 23, wherein:

the first compartment is designed to be sealable; and the second compartment is designed to remain open at all times.

25. The case of claim 23, wherein:

the second compartment is larger than the first compartment.

26. The case of claim 23, wherein:

the first compartment is sized to fit a laptop computer; and the second compartment is sized to fit at least a power cord and a transformer for the laptop computer.

27. The case of claim 26, wherein:

the first compartment and the second compartment are configured to allow the power cord to be coupled to the laptop computer without requiring a portion of the power cord to extend outside of the case while the laptop computer is located in the first compartment and while the transformer is located in the second compartment; and the portion of the power cord is located between the transformer and the laptop computer.

28. The case of claim 23, wherein:

an exterior surface of the first compartment comprises a recess; and the recess is a second portion of the handle.

29. The case of claim 1, wherein:

the pocket is sized to fit at least a power cord and a transformer for the portable computer.

30. The case of claim 29, wherein:

the base shell and the cover shell are configured such that the power cord can be coupled to the portable computer through at least a first one or the one or more second apertures without requiring a portion of the power cord to extend outside of the case while the bottom of the portable computer is resting on the one or more pads and while the transformer is located in the pocket.

31. The case of claim 1, wherein:

the one or more first apertures in the outer cover panel open from an exterior of the case into the pocket;

the cover shell and the base have a first compartment therebetween when the cover shell is in the first position relative to the base shell; and the one or more second apertures in the inner cover panel open from the first compartment into the pocket.

32. The case of claim 1, wherein:

a portion of the base shell and one of the one or more first apertures in the outer cover panel are configured to be used in combination as a handle to carry the case.

33. The case of claim 23, wherein:

the first compartment comprises:

a first outer panel;

the second compartment comprising:

a second outer panel with the opening; and an inner cover panel coupled to the second outer panel; and a hinge pivotally coupling the first outer panel of the first compartment to the inner cover panel of the second compartment such that a laptop computer can be placed between the first outer panel of the first compartment and the inner cover panel of the second compartment.

34. A case configured to hold a portable computer with a keyboard, the case comprising:

a base shell comprising:

a base panel with a first side; and one or more pads extending from the first side and positioned such that a bottom of the portable computer is configured to rest on the one or more pads;

a cover shell comprising:

an outer cover panel; and an inner cover panel coupled to the outer cover panel; and a hinge coupling to the base shell to the cover shell such that the cover shell can move between a closed position, in which a user cannot type on the keyboard of the portable computer while the portable computer is inside of the case, and an open position, in which a user can type on the keyboard of the portable computer while the portable computer is inside of the case, wherein:

the cover shell has a pocket located between the outer cover panel and the inner cover panel;

the outer cover panel has one or more first apertures extending from an exterior of the case into the pocket;

the inner cover panel has one or more second apertures into the pocket;

the pocket is sized to fit at least a power cord and a transformer for the portable computer;

the base shell and the cover shell are configured such that the power cord can be coupled to the portable computer through at least a first one or the one or more second apertures without requiring a portion of the power cord to extend outside of the case while the bottom of the portable computer is resting on the one or more pads and while the transformer is located in the pocket;

a first one of the one or more first apertures is a first portion of a handle for the case; and the portable computer is removable from the case.

35. The case of claim 23, wherein:

the first compartment comprises:

a first outer panel;

the second compartment comprising:

a second outer panel with the opening; and an inner cover panel coupled to the second outer panel and the first outer panel;

the inner panel separates the first compartment from the second compartment; and the aperture in the second compartment is located in the inner panel.

* * * * *